US005386479A

United States Patent [19]

Hersh

[11] Patent Number: 5,386,479

[45] Date of Patent: Jan. 31, 1995

[54] PIEZOELECTRIC SOUND SOURCES

[76] Inventor: Alan S. Hersh, 22305 Cairnloch St., Calabasas, Calif. 91302

[21] Appl. No.: 980,268

[22] Filed: Nov. 23, 1992

[51] Int. Cl.[6] ..... H04R 25/00

[52] U.S. Cl. ..... 381/190; 381/182; 381/159

[58] Field of Search ..... 381/88, 90, 182, 71, 381/159, 190; 310/311

[56] References Cited

U.S. PATENT DOCUMENTS 3,873,866 3/1975 Goble .
3,982,142 9/1976 Goble .
3,997,804 12/1976 Tamura et al. .
4,042,845 8/1977 Hackett .
4,181,819 1/1980 Cammack ..... 381/90
4,278,851 7/1981 Takaya .
4,413,198 11/1983 Bost .
4,430,529 2/1984 Nakagawa et al. .
4,593,160 6/1986 Nakamura .
4,602,245 7/1986 Yang et al. .
4,624,337 11/1986 Shavers ..... 381/90
4,654,554 3/1987 Kishi ..... 381/190
4,700,177 10/1987 Nakashima et al. .
4,963,855 10/1990 Kojima .

*Primary Examiner*—Curtis Kuntz
*Assistant Examiner*—Sinh Tran
*Attorney, Agent, or Firm*—Blakely, Sokoloff, Taylor & Zafman

[57] ABSTRACT

A sound generator that has a plurality of acoustic piezoelectric transducers coupled to a single Helmholtz resonator. The resonant frequency of the Helmholtz resonator and each transducer can be intentionally chosen to be different so as to be stagger tuned so that the sound generator can create intense sound waves over a broad frequency range.

6 Claims, 3 Drawing Sheets

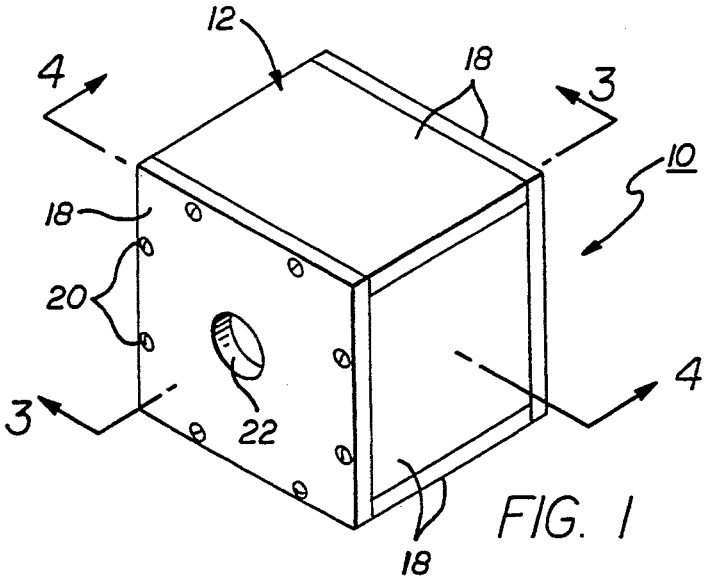
FIG. 1
FIG. 2
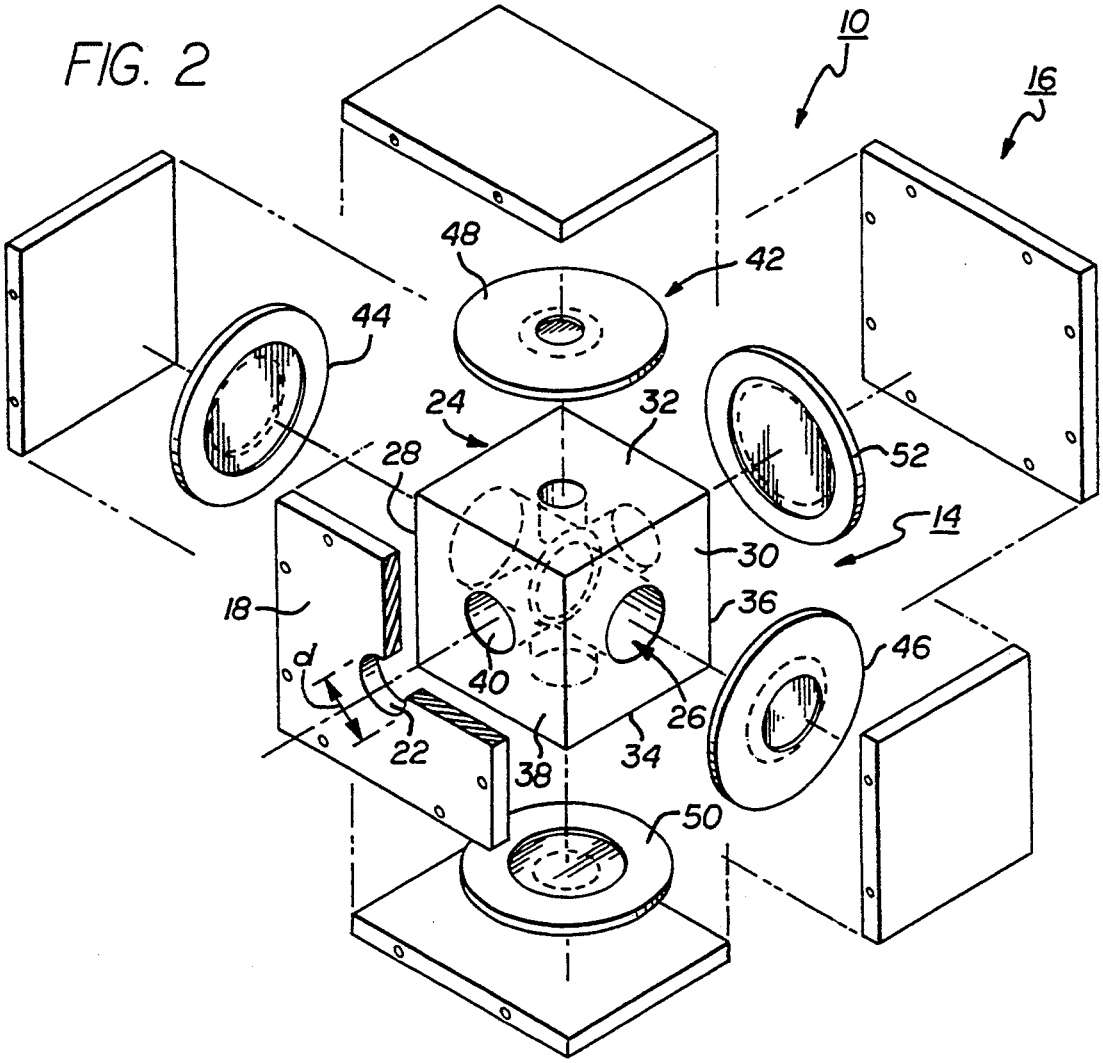

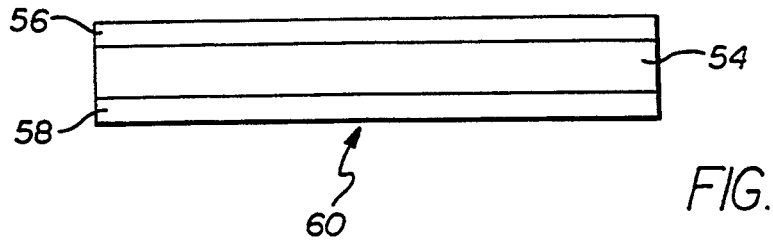
FIG. 5
FIG. 6
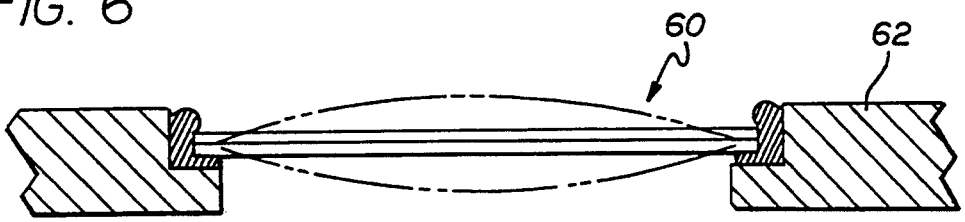
FIG. 7
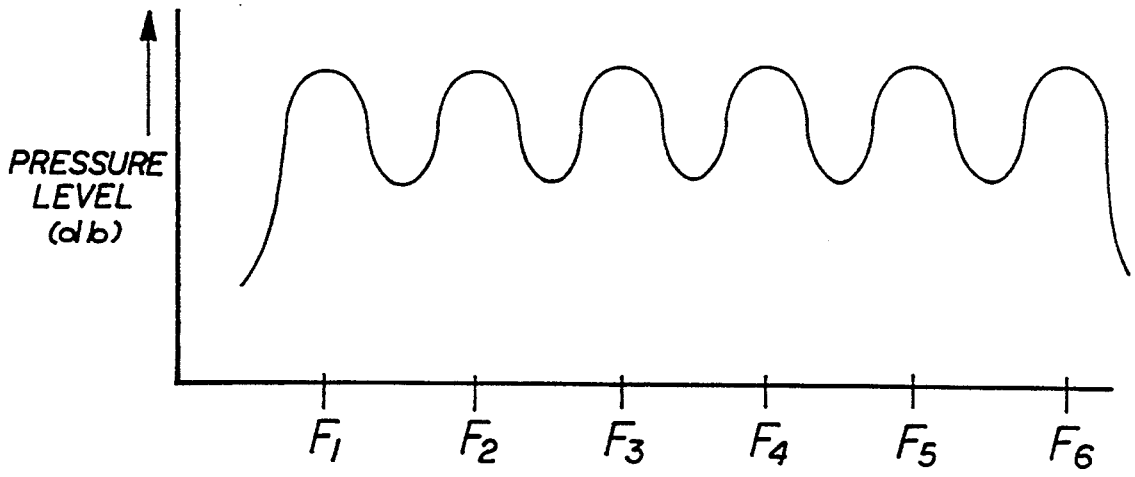

PIEZOELECTRIC SOUND SOURCES

BACKGROUND OF THE INVENTION

1. Field of the Invention

The present invention relates to acoustic generators, in particular Helmholtz resonators.

2. Description of Related Art

It has always been desirable to control the noise, particularly the audible noise of engines or machines. Noise control can increase the comfort and experience of riding in an airplane or an automobile. Noise control and cancellation is typically achieved in flow ducts by generating a sound wave that is of the same amplitude and frequency, yet 180° out of phase with the noise. Through superposition, the generated sound wave subtracts from the noise to eliminate or reduce the intensity of the undesirable sound.

Present active noise reduction systems typically have a sound transducer connected to a computer. The transducer and computer sense and digitize the noise. The computer is also connected to a sound generator. The computer analyzes the noise, and provides signals to drive the sound generator to create a sound wave that will limit or cancel the propagation of the noise. With the advancement of analytical techniques, very substantial noise reduction can now be accomplished.

One type of noise generator used in noise cancellation systems is an active Helmholtz generator. A Helmholtz generator typically has a housing with an opening that allows air flow between an internal housing cavity and the region external to the opening. Sound is created in active Helmholtz generators by displacing the air within the cavity, which moves the air within the opening. The Helmholtz resonator can be modeled as a mass/spring assembly, wherein the air within the cavity functions as a spring, and the air within the opening region as an oscillating mass. Each Helmholtz resonator therefore has a resonant frequency at which the highest intensity of audio sound is generated for a given input energy. Additionally, the Helmholtz resonator contains very high frequency acoustic resonance within the cavity of the resonator. Unfortunately, the frequency band of a single Helmholtz resonator, being a tuned system, is somewhat narrow, thereby limiting the frequency range of the noise that can be canceled in an active noise control system.

U.S. Pat. No. 4,413,198 issued to Bost discloses a sound generator that includes a piezoelectric transducer coupled to a pair of Helmholtz resonators. The resonant frequency of each Helmholtz resonator is different from the resonant frequency of the transducer. When the transducer is excited, the sound generator can provide sound of substantial intensity across the range of the three resonant frequencies of the transducer and resonators.

Further increasing the frequency range of sound using the Bost device would require the inclusion of additional housing units each with varying resonant frequencies. Providing extra units would add to the bulk, weight and cost of the overall system. It would therefore be desirable to have a sound generator that was compact, light and was capable of providing a broad frequency range of sound waves.

SUMMARY OF THE INVENTION

The present invention is a sound generator that has a plurality of piezoelectric transducers coupled to a single Helmholtz resonator cavity. The resonant frequency of the Helmholtz resonator and each transducer is different, yet appropriately stagger tuned so that the sound generator can create relatively intense sound waves over a broad frequency range.

The exemplary sound generator disclosed has a cubical inner casing within an outer casing. The inner casing has an air chamber with an opening on one wall, and five piezoelectric transducers, each attached to or forming one of the other five walls of the casing. The casing is constructed and transducers selected so that the cavity and each transducer has a different resonant frequency. The transducers are connected to an appropriate source of electrical power which can drive the transducers and cause a displacement of air within the chamber over the frequency band of interest. The chamber displacement moves the air within the opening to produce the desired pressure waves. While the intensities of the pressure waves are greatest at the resonant frequencies of the transducers and the Helmholtz resonator, the combination of the resonator and five transducers, if chosen to be appropriately stagger tuned, provide a relatively wide band intense frequency response.

Therefore it is an object of the present invention to provide a sound generator that can produce sound waves over a broad frequency range.

It is also an object of the present invention to provide a sound generator which can produce a broad frequency range of sound waves that is both light and compact.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view of a sound generator of the present invention;

FIG. 2 is an exploded view of the sound generator of FIG. 1;

FIG. 5 is a side view showing the construction of a piezoelectric acoustic transducer;

FIG. 6 is a side view showing the piezoelectric acoustic transducer moving in an oscillatory manner;

FIG. 7 is a graph of the pressure intensity of the sound waves generated by the generator as a function of frequency.

DETAILED DESCRIPTION OF THE INVENTION

Figure 3:
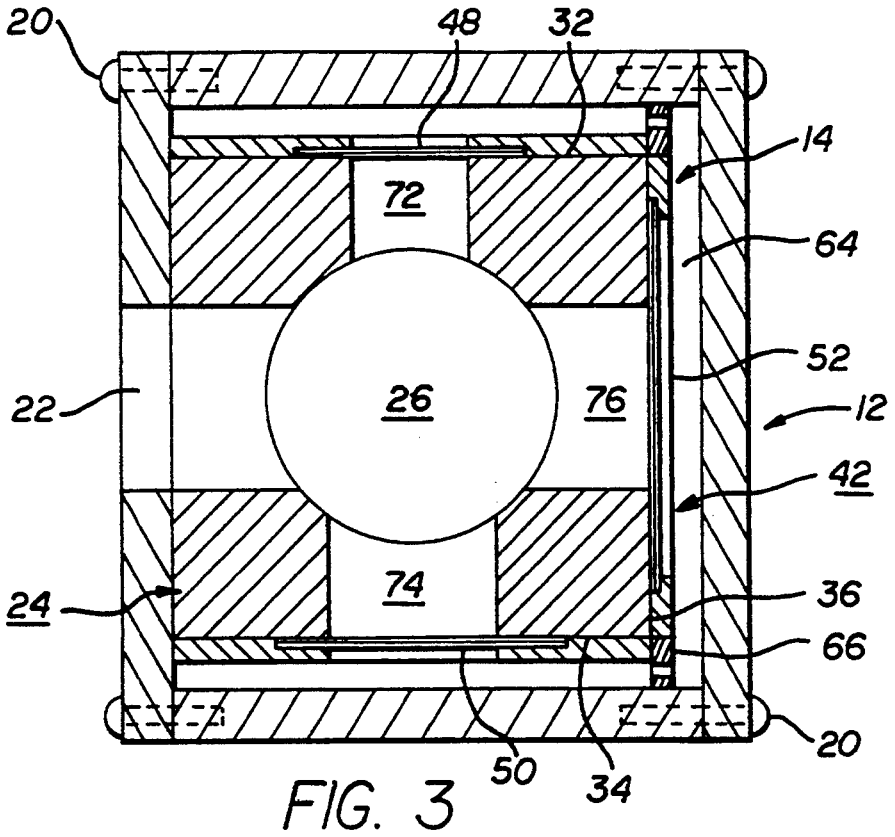
FIG. 3 is a cross-sectional view of the sound generator of FIG. 1, taken at line 3—3.

Referring to the drawings more particularly by reference numbers, FIG. 1 shows a sound generator 10 of the present invention. The generator is capable of creating intense sound waves for its size that can be used to cancel or reduce other unwanted sound. In addition to noise cancellation the sound generator of the present invention can be used in other applications. For example, the generator can be used as a speaker for creating audible sound, such as an emergency vehicle siren, or a loudspeaker for an office or home. The generator could be used as a source of sound to conduct sonic fatigue test on airborne vehicles. The generator could also be used to effect the fluid boundary layer on the airfoil of an airplane. The present invention is particularly suitable for use in sound control on vehicles that are sensitive to weight and space, such as an aircraft or an automobile.

As shown in FIG. 2, the generator 10 has a housing 12 that includes an inner casing 14 within an outer casing 16. The outer casing 16 is preferably assembled from six different walls 18 that are bolted together by a plurality of screws 20. Although screws 20 are shown and described, it is to be understood that the walls 18 may be attached by other means such as brazing or soldering. One of the walls 18 has an opening 22, typically circular in shape having a diameter d.

The inner casing 14 in the exemplary embodiment is constructed as a block 24 which contains an air chamber 26. The block 24 is cubical in shape and has a first sidewall 28, a second sidewall 30, a top wall 32, a bottom wall 34, a back wall 36 and a front wall 38. The front wall 38 has a block opening 40 that allows fluid communication between the air chamber 26, opening 22 and the region external to the opening.

Figure 4:
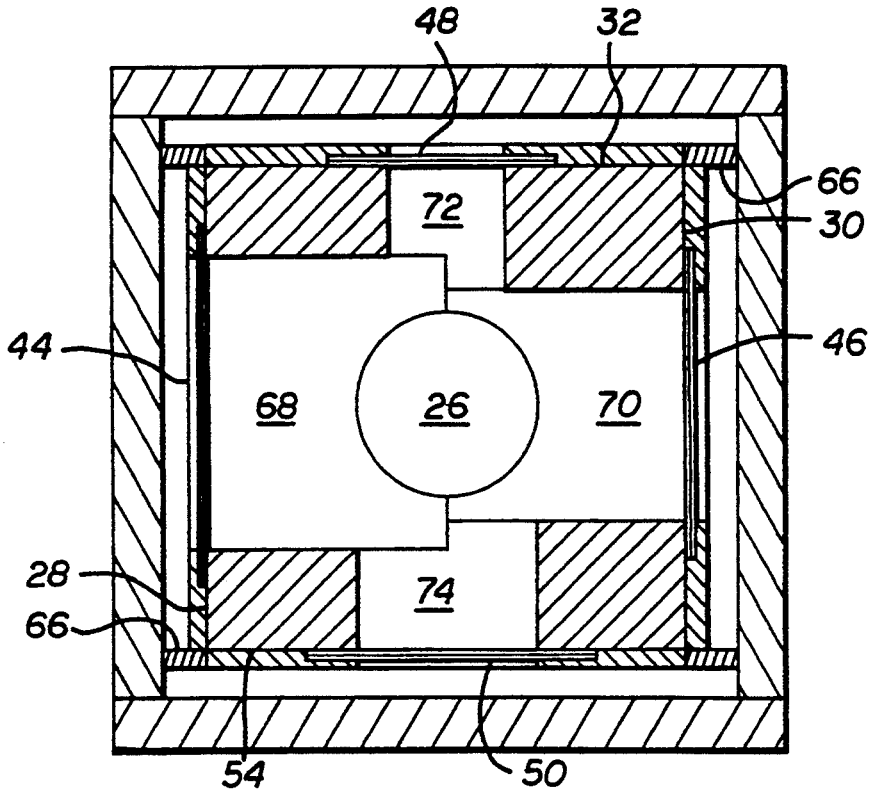
FIG. 4 is a cross-sectional view of the sound generator of FIG. 1, taken at line 4—4.

As shown in FIGS. 3 and 4, attached to the block 24 are a number of acoustic transducers 42 that are capable of introducing acoustic energy into the air chamber 26. In the preferred embodiment, a first transducer 44 is attached to the first sidewall 28, a second transducer 46 is attached to the second sidewall 30, a third transducer 48 is attached to the top wall 32, a fourth transducer 50 is attached to the bottom wall 34 and a fifth transducer 52 is attached to the back wall 36.

FIG. 5 shows a preferred embodiment of the transducers 44–52. Each transducer has a membrane 54 attached to a first piezoelectric disk 56 and a second piezoelectric disk 58. The membrane 54 is preferably constructed from a polymer approximately 0.015 inches thick. The disk 56 and 58 are preferably constructed from a piezoelectric material approximately 0.008 inches thick. The piezoelectric disk are preferably constructed from a ceramic material. For example, the disk may be constructed from a material sold under the designation PZT/G1195.

As shown in FIG. 6, the membrane/disk assembly 60 is mounted to a transducer plate 62. The assembly 60 is preferably attached to the transducer plate 62 by a silicon (flexible) adhesive which provides a strong bond and is resistive to most hostile environments. Although a silicon adhesive is described, it is to be understood other means of attachment may be employed. The plates 62 are attached to the walls of the block 24 by fastener or attachment means such as an adhesive.

The piezoelectric disk 56 and 58 are connected to a source of electrical power that can apply a voltage to the piezoelectric disk. Applying an AC voltage to the transducer, causes the piezoelectric materials to undergo a periodic strain, moving the assembly 60 in an oscillatory matter as shown in FIG. 6. Movement of the transducers induces a change in volume within the air chamber 26 at the frequency or frequencies of the movement.

As shown in FIG. 3, a space 64 typically exists between the inner casing 14 and outer casing 16 to allow the transducers to move relative to the block 24. The separation of the casings also serves to isolate the sound generated by the movement of air within the chamber 26, so that the sound is not propagated to the adjacent environment. Also support members 66 may be placed between the inner and outer casings, the support members either allowing air flow between the transducers. While these two alternatives effect the dynamics of the system, the differences may be generally compensated for by selection of the piezoelectric elements.

The air chamber 26 and opening 22 create a Helmholtz resonator which has a resonant frequency. The resonator can be modeled as a simple spring/mass dynamic system, wherein the air within the opening 22 is the mass and the air within the chamber 26 functions as a spring. The spring (air in the chamber) is excited by an external force (transducers) which cause the mass (air within opening) to move accordingly. The resonant frequency of the resonator can be varied by changing the volume of the air chamber 26 and/or the volume of the opening 22.

In the exemplary embodiment, the block 24 is constructed from a rigid material such as aluminum. The chamber 26 can be created by drilling a plurality of holes into the block 24. The holes define a first cavity 68 that is adjacent to the first transducer 44, a second cavity 70 that is adjacent to the second transducer 46, a third cavity 72 that is adjacent to the third transducer 48, a fourth cavity 74 that is adjacent to the fourth transducer 50, and a fifth cavity 76 that is adjacent to the fifth transducer 52. The cavities 68–76 each have a different cross-sectional area, such that the disk/membrane assembly 60 area exposed to the chamber 26 is different for each transducer. The resonant frequency of the transducers is a function of the rigidity of the transducers which in turn depends on the exposed disk/membrane assembly area. Varying the area changes the spring rate of the disk/membrane assembly and the resonant frequency of the transducers. The resonant frequency of each transducer is therefore different, because of the different cavity cross-sections within the block. Although different transducer resonant frequencies are shown and described, it is to be understood that some-or all of the transducers may have the same resonant frequencies. For example, the first 44 and second 46 transducers may have the same resonant frequencies, whereby the intensity of the pressure wave created by the first and second transducers at their resonant frequency is greatly increased.

FIG. 7 shows the intensity of the sound wave created by the generator as a function of frequency. The block may be constructed so that the resonant frequencies of the Helmholtz resonator and transducers are stagger tuned or spaced apart over a relative broad range of frequencies. For example, the resonator may have a resonant frequency f1 of 500 Hertz (Hz), the first transducer 44 may have a resonant frequency f2 of 1000 Hz, the second transducer 46 may have a resonant frequency f3 of 1500 Hz, the third 48, fourth 50 and fifth 52 transducers may have resonant frequencies f4, f5 and f6, of 2000, 3000 and 4000 Hz, respectively. As shown in the graph, the intensity levels of the sound wave are greatest at each resonant frequency, though because of the stagger tuning, the intensity falls off between resonant points by a relatively small amount. The extent of flatness in the response and the bandwidth of the frequency response maybe varied depending on the requirements of a particular application.

While the exemplary embodiment described herein utilized an aluminum block for the cavity, in most applications the cavity would be formed utilizing lighter weight construction techniques, such as sheet metal fabrication techniques.

The present invention provides a single unit that can generate sound waves in various frequency ranges. The generator may be connected to a controller or computer that may drive all of the transducers simultaneously or sequentially, depending on the application. Additionally, the control means may selectively drive only one, or two, etc., transducers at a time. The present invention may therefore be used in an active sound control system that can operate over a broad range of frequencies.

While certain exemplary embodiments have been described in detail and shown in the accompanying drawings, it is to be understood that such embodiments are merely illustrative of and not restrictive on the broad invention and that the present invention not be limited to the specific arrangements and constructions shown and described, since various other modifications may occur to those ordinarily skilled in the art.

What is claimed is:

1. An acoustic generator, comprising:

a housing having a chamber and an opening, said chamber and opening defining a Helmholtz resonator having a first resonant frequency f1, said housing further having first, second, third, fourth and fifth cavities in fluid communication with said opening, each cavity having a different volume;

a first acoustic transducer operatively connected to said housing adjacent to said first cavity and adapted to generate acoustic energy within said chamber;

a second acoustic transducer operatively connected to said housing adjacent to said second cavity and adapted to generate acoustic energy within said chamber;

a third acoustic transducer operatively connected to said housing adjacent to said third cavity and adapted to generate acoustic energy within said chamber;

a fourth acoustic transducer operatively connected to said housing adjacent to said fourth cavity and adapted to generate acoustic energy within said chamber; and, a fifth acoustic transducer operatively connected to said housing adjacent to said fifth cavity and adapted to generate acoustic energy within said chamber.

2. The acoustic generator as recited in claim 1, wherein said housing has an inner casing separated from an outer casing by a housing space, said inner casing containing said cavities and being adapted to support said acoustic transducers.

3. The acoustic generator as recited in claim 2, wherein each said acoustic transducer has a membrane adjacent to a first piezoelectric disk and a second piezoelectric disk.

4. The acoustic generator as recited in claim 3, wherein said piezoelectric disks are constructed from a ceramic material.

5. An acoustic generator, comprising:

an outer casing having an opening;

an inner casing having a first sidewall, a second sidewall, a top wall, a bottom wall and a back wall, said inner casing further having a first cavity adjacent to said first sidewall, a second cavity adjacent to said second sidewall, a third cavity adjacent to said top wall, a fourth cavity adjacent to said bottom wall and a fifth cavity adjacent to said back wall, each cavity having different areas and being in fluid communication with said opening in said outer casing;

a first piezoelectric acoustic transducer attached to said first sidewall and adapted to generate acoustic energy within said inner casing, said first piezoelectric acoustic transducer having a first resonant frequency f1;

a second piezoelectric acoustic transducer attached to said second sidewall and adapted to generate acoustic energy within said inner casing, said second piezoelectric acoustic transducer having a second resonant frequency f2;

a third piezoelectric acoustic transducer attached to said top wall and adapted to generate acoustic energy within said inner casing, said third piezoelectric acoustic transducer having a third resonant frequency f3;

a fourth piezoelectric acoustic transducer attached to said bottom wall and adapted to generate acoustic energy within said inner casing, said fourth piezoelectric acoustic transducer having a fourth resonant frequency f4; and, a fifth piezoelectric acoustic transducer attached to said back wall and adapted to generate acoustic energy within said inner casing, said fifth piezoelectric acoustic transducer having a fifth resonant frequency f5.

6. The acoustic generator as recited in claim 5, wherein each said piezoelectric acoustic transducer has a membrane adjacent to a first piezoelectric disk and a second piezoelectric disk.

* * * * *